United States Patent [19]

Shu et al.

[11] Patent Number: 4,504,377

[45] Date of Patent: Mar. 12, 1985

[54] PRODUCTION OF STABLE LOW VISCOSITY HEATING OIL

[75] Inventors: Paul Shu, Princeton Junction, N.J.; Tsoung Y. Yan, Philadelphia, Pa.

[73] Assignee: Mobil Oil Corporation, New York, N.Y.

[21] Appl. No.: 559,670

[22] Filed: Dec. 9, 1983

[51] Int. Cl.[3] ..... C10G 51/02

[52] U.S. Cl. ..... 208/75; 208/72; 208/106; 208/126; 208/127; 208/130; 208/251 R; 208/254 R

[58] Field of Search ..... 208/72, 75, 49, 106, 208/254 R, 126, 127, 130, 251 R

[56] References Cited

U.S. PATENT DOCUMENTS 3,954,599 5/1976 Ooka ..... 208/126

4,017,380 4/1977 Byler et al. ..... 208/49

4,062,757 12/1977 Beuther et al. ..... 208/126

4,268,375 5/1981 Johnson et al. ..... 208/75

4,379,747 4/1983 Yan ..... 208/251 R

*Primary Examiner*—Delbert E. Gantz

*Assistant Examiner*—Anthony McFarlane

*Attorney, Agent, or Firm*—A. J. McKillop; M. G. Gilman; J. F. Powers, Jr.

[57] ABSTRACT

This invention provides a two-stage visbreaking process for increasing the production of a visbroken hydrocarbon product from heavy oil feedstock, which meets heating oil viscosity specifications with little or no blending with external cutter stocks.

The second stage visbreaking is conducted at a relatively high Severity in contact with a fluidized bed of particulate solids.

13 Claims, 3 Drawing Figures

Fig. 1 SHAKER BOMB DATA

TOLUENE-INSOLUBLES FORMATION TENDENCY OF VISBREAKER CHARGE STOCKS

| NO. | STOCK | ASPHALTENE CONTENT, % WT. |
|---|---|---|
| 1. | 12% Oficino-Ouico residuum | 24.44 |
| 2. | P.D. Tar from Kuwait 346 stock | 14.00 |
| 3. | 24% Kuwait residuum | 10.90 |
| 4. | Petrolatum | 6.60 |
| 5. | Furfural extract from Tibu Petrolea 362 stock | 3.32 |
| 6. | Petrolatum filtrate | 3.12 |
| 7. | TCC No. 2 Syn. tower bottoms | 2.92 |
| 8. | TCC No. 1+2 Syn. tower bottoms blend | 2.66 |
| 9. | TCC No. 1 Tar separator bottoms | 2.59 |
| 10. | TCC No. 1 Syn. tower bottoms | 2.53 |
| 11. | TCC No. 2 Tar separator bottoms | 1.78 |
| 12. | Furfural extract from coastal grade A 678 stock | 1.20 |
| 13. | P.D. Raffinate from Kuwait 346 stock | 0.98 |
| 14. | Furfural extract from Kuwait 346 stock | 0.38 |

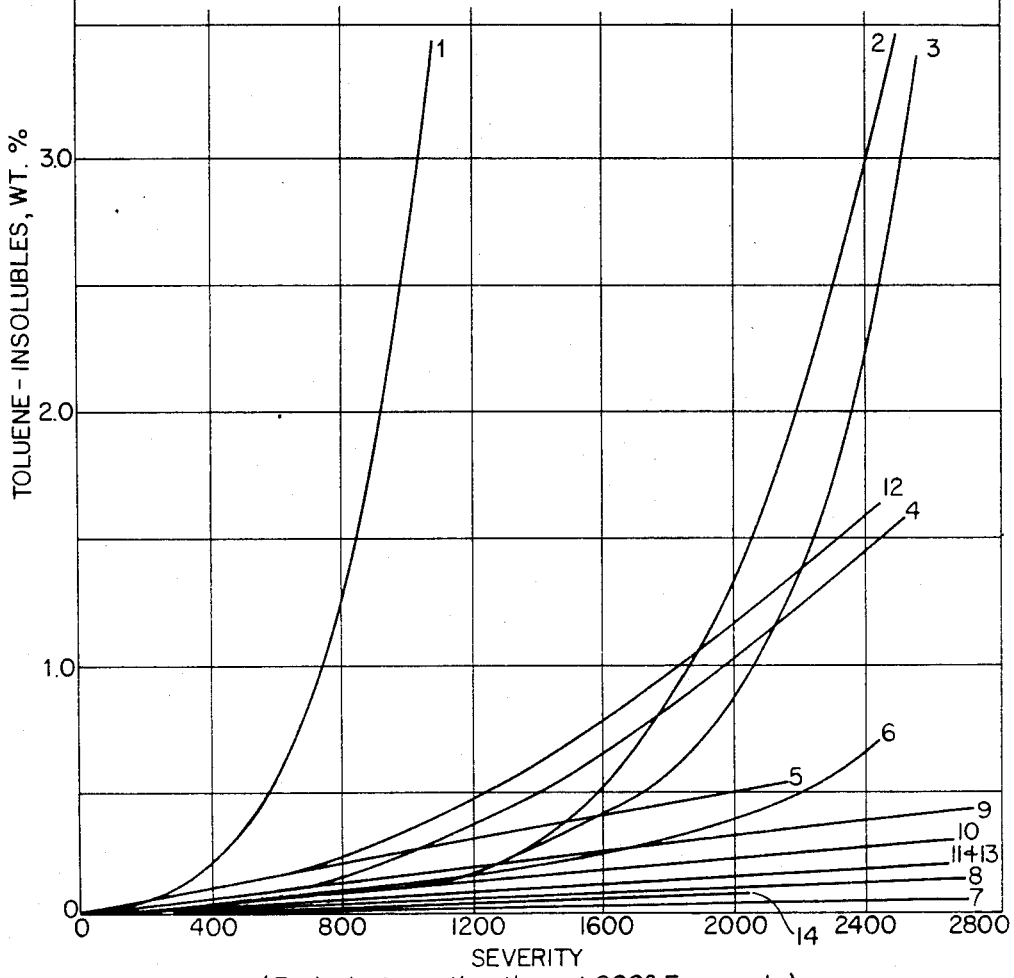

PRODUCTION OF STABLE LOW VISCOSITY HEATING OIL

BACKGROUND OF THE INVENTION

Visbreaking is a mild cracking operation used to reduce the viscosity of heavy residua. The heavy residua are sometimes blended with valuable light oil, or cutter stocks, to produce fuel oils of acceptable viscosity. By use of visbreakers, the viscosity of the heavy residua is reduced so as to lower the requirement of the cutter stock. The ultimate objective of the visbreaking operation is to eliminate completely the need for cutter stocks.

Sometimes visbreakers are also used to generate more gas oils for catalytic cracking and naphtha for reforming to increase the gasoline yield in the overall refining operation. To achieve these goals, the visbreaker has to be operated at high enough Severity to generate sufficient quantities of lighter products.

The visbreaker feedstock usually consists of a mixture of two or more refinery streams derived from sources such as atmospheric residuum, vacuum residuum, furfural-extract, propane-deasphalted tar and catalytic cracker bottoms.

The economic and environmental factors relating to upgrading of petroleum residual oils and other heavy hydrocarbon feedstocks have encouraged efforts to provide improved processing technology, as exemplified by the disclosures of various U.S. patents which include U.S. Pat. Nos. 2,160,814; 2,358,573; 2,695,264; 2,733,192; 3,065,165; 3,696,027; 3,730,879; 3,775,303; 3,870,621; 3,876,530; 3,882,049; 3,897,329; 3,905,893; 3,901,792; 3,964,995; 3,985,643; 4,016,067; 4,054,504; 4,379,747; and the like.

Accordingly, it is an object of this invention to provide a process for improving the performance of visbreakers for the production of an increased yield of light products such as heating oil and gas oil from a heavy oil feedstock.

It is another object of this invention to provide a process for the production of a visbroken hydrocarbon product which meets heating oil viscosity specifications with little or no blending with external cutter stocks, and which has a metals content less than about 50 parts per million.

It is a further object of this invention to provide an improved visbreaking process for the production of a visbroken effluent which is stable and compatible and which can be blended with other fuel range stocks without formation of sludge or precipitate.

Other objects and advantages of the present invention will become apparent from the accompanying description and illustrated data.

DESCRIPTION OF THE INVENTION

One or more objects of the present invention are accomplished by the provision of a process for increasing the production of stable heating oil from heavy oil feedstock by improving visbreaking performance in steps which comprise (1) heat-treating a mixture of heavy oil feedstock and steam in a first stage visbreaking zone at the highest Severity that yields less than about 0.5 weight percent coke deposition; (2) introducing the first stage visbroken effluent into a second stage visbreaking zone containing a bed of particulate solids, and heat-treating the said visbroken effluent at the highest Severity that yields a second stage visbroken effluent with not more than about 0.5 weight percent toluene-insoluble content as determined by Shaker Bomb test; and (3) fractionating the second stage visbroken effluent to provide a stable low viscosity heating oil product.

The term "heavy oil feedstock" is meant to include petroleum oil residua and oil sand bitumen feedstocks, in which mixtures at least 75 weight percent of the hydrocarbon constituents have a boiling point above about 700° F.

Typically, a heavy hydrocarbon oil suitable for treatment in accordance with the present invention has a metals content of at least 50 ppm, and a Conradson Carbon Residue content of at least 10 weight percent.

An important aspect of the invention process is the improvement of visbreaker performance by optimizing operation Severity in the first and second stage visbreaking zones. The visbreaking stages can be in separate reactors, or they can be contained in a single vessel divided into an integrated system of separate visbreaking zones.

The Severity of visbreaking zone conditions is expressed in terms of Severity(S), which is equal to Soaking Factor multiplied by reaction time. The parameters are reaction temperature and reaction time.

Severity is conveniently expressed in terms of "equivalent reaction time in seconds" (ERT), as measured at 800° F.

The expressions "Severity"(S) and "Soaking Factor"(SF) as employed herein refers to the following algorithmic relationship of visbreaking parameters:

$$\text{Severity(S)} = \text{Soaking Factor}(SF_{800}) \times \text{Residence Time}(\theta)$$

In order to express Severity(S) in terms of ERT as measured at 800° F., the SF relative to that at 800° F. has to be employed.

Since the coil temperature is not uniform, the average Soaking Factor(SF) for the whole coil reactor is obtained as follows:

$$SF_{800} = \int_{800}^{T_f} \left( \frac{k_T}{k_{800}} \right) dV$$

To integrate the above equation, the coil temperature profile relating to the reactor volume V (indirectly through distance from the inlet L) has to be determined experimentally or calculated, which can be expressed mathematically as follows:

$$T = f(L) = F(V)$$

By differentiation, we obtain:

$$dT = F'(V)dv \qquad dV = \frac{1}{F'(V)} dT$$

Therefore, $SF_{800}$ becomes:

$$SF_{800} = \int_{800}^{T_f} \left( \frac{k_T}{k_{800}} \right) \frac{dT}{F'(V)}$$

and the equation can be integrated either analytically or graphically to obtain $SF_{800}$.

Where:

T, $T_f$=coil temperatures at any position and the outlet, respectively, °F.

$SF_{800}$=soaking factor relative to that at 800° F. base temp.

$k_T/k_{800}$=ratio of reaction rate constants at T and 800° F.

dV=differential coil volume, $ft^3$/bbl/day.

$\theta$=residence time, seconds.

L=distance from the inlet, ft.

Note that $S=SF_{800}\times\theta$ (the first equation above). That is, Severity is proportional to residence time($\theta$); that is why the Severity is often expressed in terms of $\theta$, i.e., equivalent reaction time at 800° F.

BRIEF DESCRIPTION OF THE DRAWINGS

FIGS. 1 and 2 represent inventive results and FIG. 3 represents a schematic flow scheme of the invention.

As the Severity level in a visbreaking zone increases to produce lower viscosity product, the toluene-insolubles formation tendency increases. This results in production of unstable visbroken effluent.

The toluene-insolubles forming tendency varies greatly depending on the nature of an individual heavy oil feedstock, i.e., the particular chemical constituency of the feedstock, the quantity and kind of impurity content, and the like.

In the production of a heavy fuel oil, the stability of the product depends on the Severity at which a feedstock is visbroken. If a heavy oil feedstock has been visbroken at a Severity which yields a content of less than about 0.5 weight percent toluene-insolubles (Shaker Bomb test), then the resultant fuel oil is stable. A heavy fuel oil is said to be stable if it does not form sedimentation on storage (as indicated by ASTM D2781 method).

The toluene-insolubles forming tendency of various heavy oil feedstocks can be determined by Shaker Bomb tests. Typical results are illustrated in FIGS. 1 and 2.

FIG. 1 represents a graph in which weight percent toluene-insolubles formation is plotted versus Severity (equivalent reaction time in seconds at 800° F.), with respect to Shaker Bomb toluene-insolubles formation tendency of visbreaker chargestocks.

Figure 2:
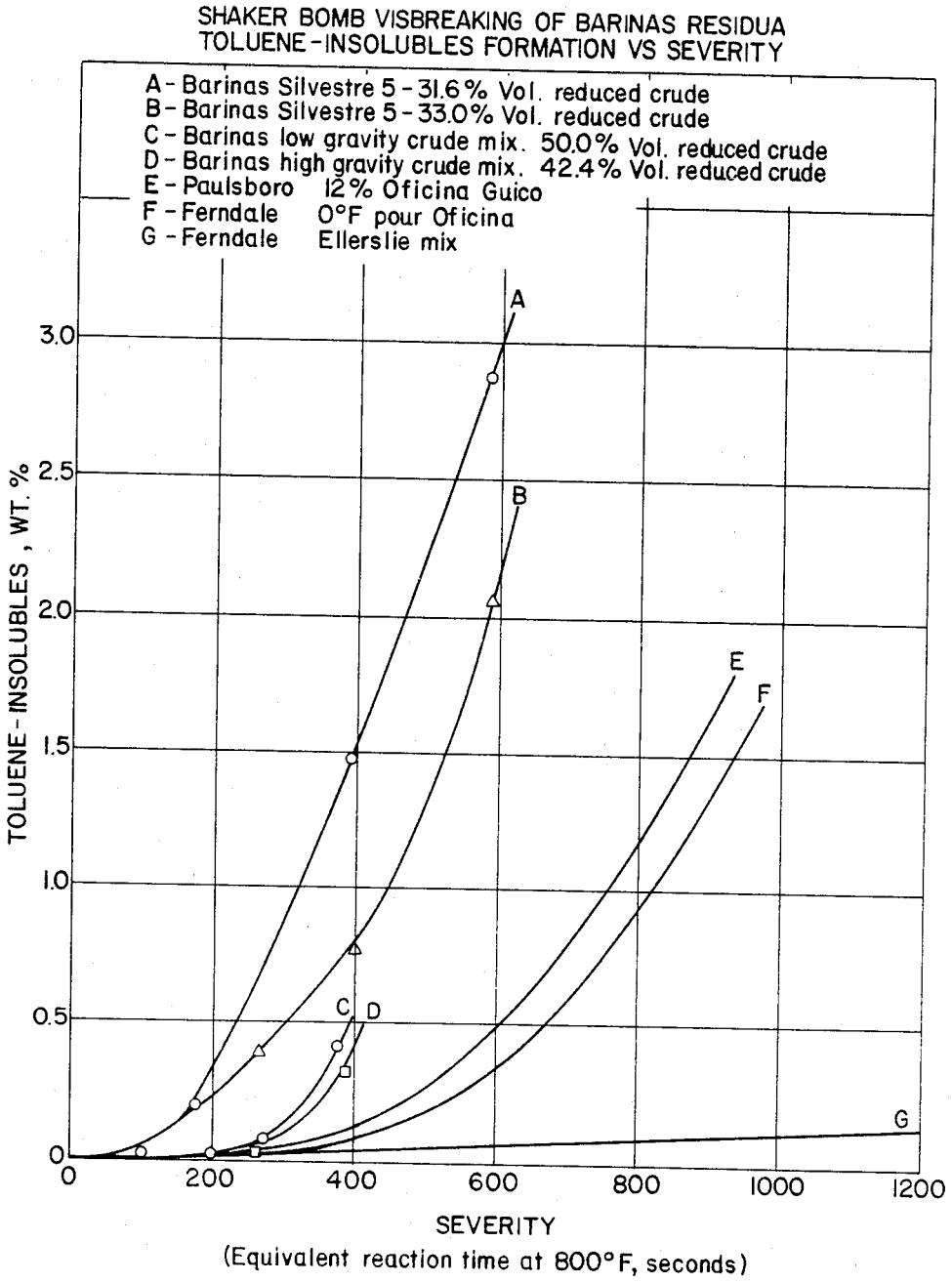

FIG. 2 represents a graph in which weight percent toluene-insolubles formation is plotted versus Severity (equivalent reaction time in seconds at (800° F.), with respect to Shaker Bomb visbreaking of Barinas residua.

In general, heat treatment in the first stage visbreaking zone of the invention process is conducted at a temperature between about 700°-900° F. and a pressure of about 100-1500 psi for a residence time between about 0.1-1 hour.

The weight ratio of steam to heavy oil feedstock charged to the first stage visbreaking zone will vary in the range between about 0.005 to 0.5.

The first stage visbreaker heat treatment is conducted under relatively mild conditions, so that typically about 10-30 weight percent of the heavy oil feedstock is cracked to lighter components.

The highest Severity in the first stage visbreaking zone usually will be less than about 800 seconds, as expressed in equivalent reaction time at 800° F. Under these conditions, the coke deposition on heater surfaces in the first stage visbreaking zone is negligible, i.e., there is little or no coke deposition.

The visbroken effluent from the first stage visbreaking zone is passed into the second stage visbreaking zone, where it is heat-treated under relatively severe conditions.

In a typical run the heat treatment of feedstock in the second stage visbreaking zone is conducted at a temperature between about 700°-1000° F. and a pressure of about 100-1500 psi for a residence time between about 0.2-2 hours, depending on Severity requirements.

The highest Severity in the second stage visbreaking zone usually is greater than about 800 seconds, as expressed in equivalent reaction time at 800° F. About 70 weight percent of the 1000° F.+ components in the heavy oil feedstock is converted by the combination of first stage and second stage visbreaker heat treatments to gas oil and heating oil range hydrocarbons, and lighter hydrocarbons.

In the second stage visbreaking zone, the liquid hydrocarbon feedstream is in contact with a fixed, moving or fluidized bed of particulate solids. Asphaltenes and organometallic compounds and CCR precursors tend to interact with the solid particle surfaces, and there is a growth of deposited insolubles on the particle surfaces. This deposition of heavy and heteroatom components on the particulate solids serves to remove these materials from the liquid hydrocarbon stream and to effect demetalation, desulfurization, denitrogenation and carbon residue rejection of the visbroken mixture, resulting in a stable product.

The second stage visbreaking conditions can be relatively severe, since the bed of particulate solids removes toluene-insoluble materials from the visbroken medium that adversely affect product stability. The resultant second stage visbroken effluent contains not more than about 0.5 percent toluene-insolubles as determined by Shaker Bomb test. The deposition of toluene-insoluble materials on the particulate solids can be promoted by addition of a low molecular weight type of hydrocarbon (e.g., naphtha) to the second visbreaking zone during the visbreaking period. The high Severity in the second stage visbreaker yields a visbroken effluent that contains a heating oil fraction which is stable, and which inherently has a low viscosity and therefore requires little or no cutter stock addition. In conventional visbreaking, the equivalent high Severity produces an unstable and incompatible heating oil fraction.

The particle solids can be selected from any of a variety of available substrates such as silica, alumina, silica-alumina, clay, raw coal, coke, and the like, or any available spent catalytic materials.

Ball mills or other types of conventional apparatus may be employed for crushing and pulverizing petroleum coke, raw coal or inorganic material in the preparation of particulate solids for the second stage visbreaking zone of the process. The crushing and grinding of the material can be accomplished either in a dry state or in the presence of a liquid such as the heavy hydrocarbon oil being employed in the practice of the invention process. The average particle size of the powder is preferably below about 0.2 inches, such as finely divided bituminous coal which has a particle size of less than about 10 mesh (U.S. Sieve Series).

A preferred type of particulate substrate is finely ground petroleum coke having a particle size in the range between about 10-200 mesh.

The particulate solids in the bed grow in size and density during the second stage visbreaking cycle. With a fluidized bed, a residual bottoms fraction of heavy solids is withdrawn continuously or intermittently from the second stage visbreaking zone. If the residual fraction comprises coke or coal solids, then the residual fraction can be reserved or sold for use as solid fuel. If the residual fraction is composed substantially of an inorganic substrate with organic-coated surfaces, the solids can be pyrolyzed free of carbon content and recycled in the process.

The second stage visbreaking zone effluent is comprised substantially of hydrocarbon components which are in the heavy fuel oil range. Less than about 20 weight percent of the total liquid effluent is composed of valuable naphtha-type light hydrocarbons, which can be recovered by steam-stripping or by fractional distillation.

The liquid hydrocarbon mixture after light end removal essentially is a stable low viscosity fraction that requires little or no blending with cutter oil to meet heavy fuel oil specifications.

Depending on the nature of the heavy oil feedstock from which it is derived, the present invention process can provide a heating oil which has a 270° F.+ bottom viscosity of less than about 2000 centistokes at 100° F., and which has a metals content less than about 50 parts per million, a sulfur content less than about 3 weight percent, a nitrogen content less than about 0.2 weight percent and a CCR content less than about 10 weight percent.

Illustrative of a heavy oil starting material for purposes of the present invention is an Arabian Light Vacuum Resid fraction having the following analysis:

| | |
|---|---|
| API, gravity | 8.3 |
| H, wt % | 10.67 |
| S, wt % | 3.93 |
| N, wt % | 0.28 |
| CCR, wt % | 16.13 |
| V, ppm | 68 |
| Ni, ppm | 17 |
| MW | 810 |

The highest Severity at which the above described Arabian Vacuum Resid can be visbroken without high toluene-insoluble formation and instability in a subsequently produced heating oil is about 900 seconds, with reference to equivalent reaction time (ERT) at 800° F. as determined by Shaker Bomb testing.

Illustrative of a suitable Shaker Bomb system for determination of heavy oil Severity properties, the reactor (bomb) is 4" in diameter and about 12" in length. The reactor is heated by high frequency electrical induction while the contents are being vigorously agitated by a reciprocal shaking action. This arrangement permits the reactor and its contents to be heated at extremely high rates (up to 40° F./sec.). The reactor can be cooled at any time with a jet of cold air, or it can be quenched at the end of the heating cycle by a spray of water. The quench-cooling rate is in the order of 20° F./sec.

Upon completion of the Shaker Bomb visbreaking reaction, the product is emptied into a beaker, and the reactor is washed with hot toluene (100° C.). The wash solution and the product are combined and further diluted with toluene to five times the original volume. This diluted solution is heated to 100° C. and then filtered through Whatman #2 filter paper. The filter cake is washed with toluene and then dried in a 100° C. oven until the weight is constant. The weight of the cake corresponds to the toluene-insolubles in the product.

Figure 3:
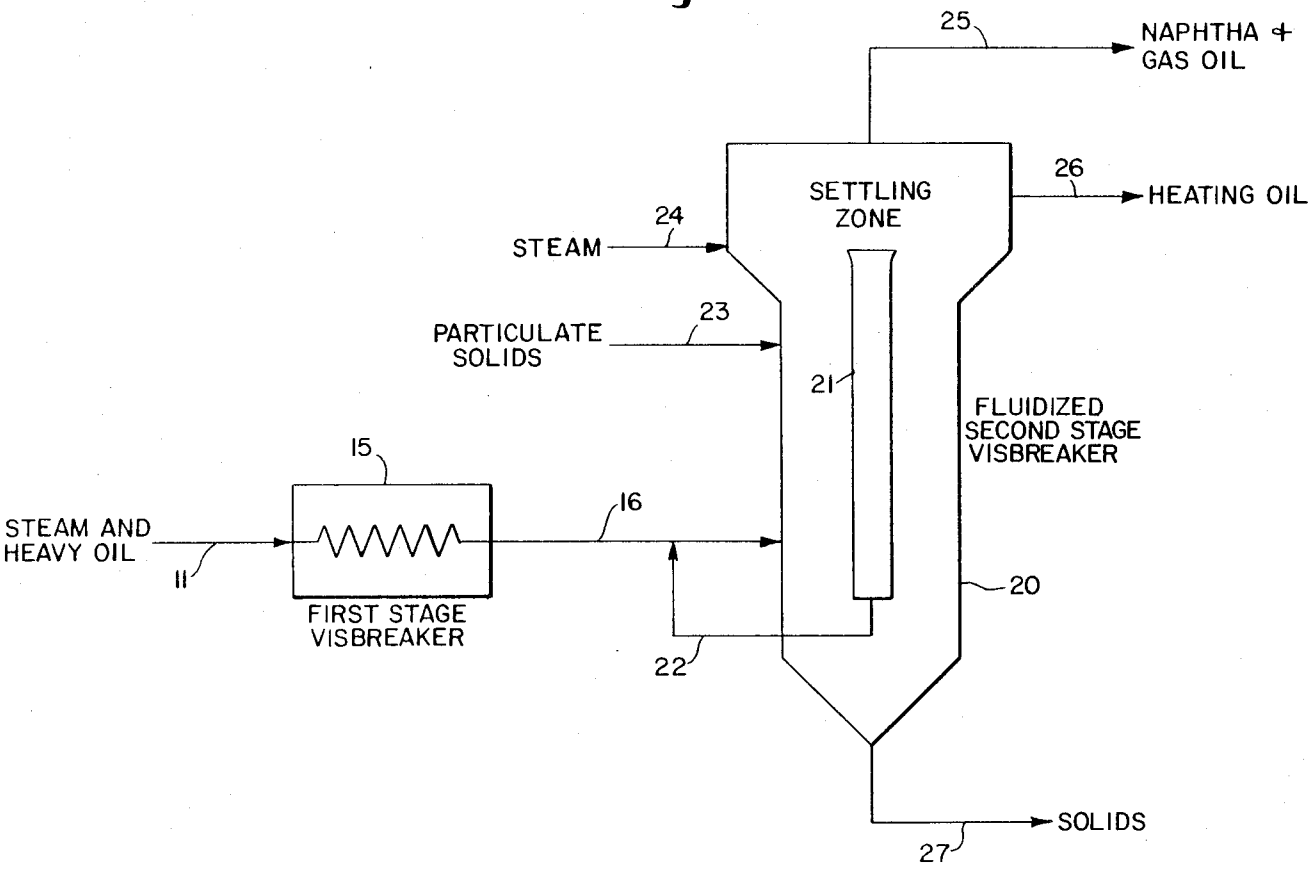

Illustrative of the invention process, FIG. 3 is a schematic representation of a first stage visbreaker in series with a second stage visbreaker for thermal conversion of heavy oil feedstock to stable low viscosity heavy fuel oil range products, in addition to naphtha and gas oil yields.

Referring to FIG. 3, a mixture of steam and heavy oil feedstock (steam/oil ratio of 0.1) is passed through a preheater and charged through line 11 into first stage Visbreaker 15, which is a tubular visbreaking furnace. The weight hourly space velocity of the feedstock is about 20. The heat treatment temperature in Visbreaker 15 is about 800° F., and the residence time of the feedstock in Visbreaker 15 is about 35 minutes. Approximately 20 percent of the heavy oil feedstock is cracked to lighter weight hydrocarbons.

The visbroken effluent from Visbreaker 15 is withdrawn through line 16 and entered into second stage Visbreaker 20, in which the hourly weight space velocity is about 15 and the oil to fluidized solids weight ratio is about 3:1. The solids are a petroleum coke powder having a particle size in the 50–200 mesh range.

The temperature in Visbreaker 20 is about 850° F., and the residence time of the upward flowing feedstock in the fluidized bed zone is about 40 minutes, and the residence time in the settling zone near the top of Visbreaker 20 is about 15–20 minutes.

Optionally, the liquid volume flow to the Visbreaker 20 fluidized bed zone can be increased by recycling visbroken feedstock which is withdrawn from Standpipe 21 through line 22.

Particulate petroleum coke solids are fed intermittenly as required into Visbreaker 20 via line 23. Steam is passed through line 24 into the settling zone of Visbreaker 20. The steam facilitates the stripping of gas, naphtha and gas oil from Visbreaker 20 through overhead line 25.

A heavy heating oil fraction is recovered from Visbreaker 20 through line 26. Heavy residual particulate solids are continuously or intermittenly removed from Visbreaker 20 by means of line 27. After stripping with steam, the residual solids are used as refinery fuel or sold as fuel coke.

The heating oil fraction recovered through line 26 as a product of the continuous visbreaking system nominally has a 270° F.+ bottom viscosity of 2000 centistokes at 100° F., and requires less than about 10 weight percent cutter stock (3 centistokes at 100° F.) blending to meet the specification of 3500 seconds Redwood #1 at 100° F.

The following Example is further illustrative of the present invention. The specific ingredients and processing parameters are presented as being typical, and various modifications can be derived in view of the foregoing disclosure within the scope of the invention.

EXAMPLE

This Example illustrates the production of stable heating oil from Joliet coker feed in accordance with the invention process.

| | Joliet Coker Feed |
|---|---|
| CCR, wt % | 19.8 |
| Asphaltene, wt % | 10.3 |

-continued

| | Joliet Coker Feed |
|---|---|
| Viscosity cs, @ 100° C. | 579.6 |

The apparatus consists of a visbreaker and a coke bed reactor. The visbreaker is a stainless steel tube reactor of 27"×⅜" operated in an upflow configuration. The effluent from the visbreaker feeds directly to the bottom of a coke bed reactor which has a capacity of 250 ml. This reactor is filled with 30 g of 20–40 mesh size petroleum coke in its narrow section at the bottom and 150 g of large shot coke at the top. The coke bed reactor is at about 800°–900° F. and 400 psig during a run.

The Joliet coker feed is mixed with steam and heated to 800°–900° C. in the visbreaker. The residence time in the visbreaker is about 30 minutes. The steam to feed ratio is about 0.1. Essentially no coke deposition occurs in the visbreaker.

The visbreaker effluent is blended with about 10 weight percent of n-heptane and fed to the coke bed reactor. The residence time of the hydrocarbon liquid in the coke bed reactor is about one hour.

Liquid and gas products are disengaged in a collecting vessel. Gas is vented through a Grove loader and the liquid product is depressurized and collected in a sampling pot. Liquid samples are analyzed immediately for insolubles content in n-heptane, toluene and 3:1 mixed solvent of n-heptane and toluene. Viscosity is measured by a Rheodynamics viscometer. As control runs, the feed is also visbroken without the coke bed treatment step.

The comparative run data are summarized in the Table. Runs 1–3 are the control runs, and Runs 4–5 are in accordance with the invention process.

The Runs 1–3 results indicate a high toluene-insolubles content in the liquid product mixture in comparison with Runs 4–5. A high toluene-insolubles content directly relates to instability in the heating oil fraction.

The Runs 4–5 data indicate that an increase of 50° F. in visbreaking Severity increases the yield of light end liquids, which results in a 3–4 fold viscosity reduction.

The toluene-insolubles content of the liquid product mixture in Runs 4–5 is essentially zero. A heating oil fraction derived from the liquid product mixture is storage stable, and does not require the addition of external cutter stock to meet viscosity specifications. The heating oil fraction further exhibits high thermal stability and high compatibility with other fuel stocks.

TABLE

Visbreaking Of Joliet Coker Feed To A Stable Heating Oil Product

| Conditions | | 1 | 2 | 3 | 4 | 5 |
|---|---|---|---|---|---|---|
| Visbreaker Temp. °F. | | 800 | 850 | 875 | 800 | 850 |
| Feed rate ml/hr | | 100 | 100 | 100 | 100 | 100 |
| Steam, % of Feed | | 10 | 10 | 10 | 10 | 10 |
| n-heptane, % of Feed | | — | — | — | 10 | 10 |
| Coke bed treatment | | No | No | No | Yes | Yes |
| Insoluble Analysis | Feed | | | | | |
| n-heptane | 12.7 | 20.1 | 23.4 | 23.8 | 20.7 | 18.2 |
| 3:1 n-heptane:toluene | 0.19 | 11.5 | 12.2 | 16.4 | 15.7 | 10.4 |
| Toluene | <0.19 | 1.3 | 2.7 | 3.2 | nil | nil |
| Composition Analysis | | | | | | |
| Asphaltenes | 12.5 | 8.6 | 11.2 | 7.4 | 5.0 | 7.8 |
| Resins | ~0 | 10.2 | 9.5 | 13.2 | 15.7 | 10.4 |
| Coke | 0.19 | 1.3 | 2.7 | 3.2 | nil | nil |
| Viscosity cs, 100° C. | 5796 | 310 | 240 | — | 440 | 160 |

What is claimed is:

1. A process for increasing the production of stable heating oil from heavy oil feedstock by improving visbreaking performance in steps which comprise (1) heat-treating a mixture of heavy oil feedstock and steam in a first stage visbreaking zone at the highest Severity that yields less than about 0.5 weight percent coke deposition, wherein the Severity is less than about 800 seconds, as expressed in equivalent reaction time at 800° F.; (2) introducing the first stage visbroken effluent into a second stage visbreaking zone containing a bed of particulate solids, and heat-treating the said visbroken effluent at the highest Severity that deposits toluene-insolubles on the particulate solids and yields a second stage visbroken effluent with not more than about 0.5 weight percent toluene-insoluble content, wherein the Severity is greater than about 800 seconds, as expressed in equivalent reaction time at 800° F.; separating the second stage visbroken effluent from the particulate solids and (3) fractionating the second stage visbroken effluent to provide a stable low viscosity heating oil product.

2. A process in accordance with claim 1 wherein the heat treatment in the first stage visbreaking zone is conducted at a temperature between about 700°–900° F. for a residence time between about 0.1–1 hour.

3. A process in accordance with claim 1 wherein the heat treatment in the second stage visbreaking zone is conducted at a temperature between about 700°–1000° F. for a residence time between about 0.2–2 hours.

4. A process in accordance with claim 1 wherein a low molecular weight hydrocarbon component is introduced into the second stage visbreaking zone to promote deposition of toluene-insolubles on the particulate solids.

5. A process in accordance with claim 1 wherein the bed of particulate solids is fluidized.

6. A process in accordance with claim 1 wherein the bed of particulate solids is moving.

7. A process in accordance with claim 1 wherein the bed of particulate solids is fixed.

8. A process in accordance with claim 1 wherein the heating oil product has a 270° F.+ bottom viscosity of less than about 2000 centistokes at 100° F.

9. A process in accordance with claim 1 wherein the heating oil product has a metals content less than about 50 parts per million.

10. A process in accordance with claim 1 wherein the heating oil product has a sulfur content less than about 3 weight percent.

11. A process in accordance with claim 1 wherein the heating oil product has a nitrogen content less than about 0.2 weight percent.

12. A process in accordance with claim 1 wherein the heating oil product has a Conradson Carbon Residue less than about 10 weight percent.

13. A process for increasing the production of stable heating oil from heavy oil feedstock by improving visbreaking performance in steps which comprise (1) heat-treating a mixture of heavy oil feedstock and steam in a first stage visbreaking zone at the highest Severity that yields less than about 0.5 weight percent coke deposition; (2) introducing the first stage visbroken effluent into a second stage visbreaking zone containing a bed of particulate coke solids, and heat-treating the said visbroken effluent at the highest Severity that deposits toluene-insolubles on the particulate coke solids and yields a second stage visbroken effluent with not more than about 0.5 weight percent toluene-insoluble content; separating the second stage visbroken effluent from the particulate solids and (3) fractionating the second stage visbroken effluent to provide a stable low viscosity heating oil product.

* * * * *

UNITED STATES PATENT AND TRADEMARK OFFICE

CERTIFICATE OF CORRECTION

PATENT NO. : 4,504,377

DATED : March 12, 1985

INVENTOR(S) : Paul Shu, et al.

It is certified that error appears in the above-identified patent and that said Letters Patent is hereby corrected as shown below:

Col. 2, line 58, the formula:

$$"dT = F(V)dv \qquad dV = \frac{1}{F(V)}\, dT"$$

should have primes (') inserted as follows:

$$--dT = F'(V)dv \qquad dV = \frac{1}{F'(V)}\, dT--$$

Col. 2, line 65, the formula:

$$"SF_{800} = \int_{800}^{T_f} \left[\frac{k_T}{k_{800}}\right] \frac{dT}{F(V)}\ "$$

should have a prime (') inserted as follows:

$$--SF_{800} = \int_{800}^{T_f} \left[\frac{k_T}{k_{800}}\right] \frac{dT}{F'(V)}\ --$$

Signed and Sealed this

*Third* Day of *September 1985*

[SEAL]

*Attest:*

DONALD J. QUIGG

*Attesting Officer* *Acting Commissioner of Patents and Trademarks - Designate*